United States Patent [19]

Schaefer, Jr.

[11] Patent Number: 4,919,210

[45] Date of Patent: Apr. 24, 1990

[54] SUBSEA WELLHEAD PROTECTION SYSTEM

[76] Inventor: Louis E. Schaefer, Jr., 313 Wright Ave., Gretna, La. 70056

[21] Appl. No.: 252,502

[22] Filed: Sep. 30, 1988

[51] Int. Cl.[5] ..... E21B 33/037

[52] U.S. Cl. ..... 166/356; 166/85; 166/363; 405/226

[58] Field of Search ..... 166/351, 356, 363, 339, 166/79, 85, 96; 405/224, 226

[56] References Cited

U.S. PATENT DOCUMENTS

| | | | |
|---|---|---|---|
| 1,721,805 | 7/1929 | Cormier . | |
| 3,063,500 | 11/1962 | Logan | 166/66.5 |
| 3,247,672 | 4/1966 | Johnson | 166/351 |
| 3,516,489 | 6/1970 | Jergins | 166/66.5 |
| 3,543,846 | 12/1970 | Smith | 166/267 |
| 4,273,472 | 6/1981 | Piazza et al. | 166/356 |
| 4,323,118 | 4/1982 | Bergmann | 166/96 |
| 4,452,312 | 6/1984 | Roblin | 166/339 |

FOREIGN PATENT DOCUMENTS

| | | | |
|---|---|---|---|
| 2035426 | 6/1980 | United Kingdom | 166/356 |

*Primary Examiner*—Jerome W. Massie
*Assistant Examiner*—Terry Lee Melius
*Attorney, Agent, or Firm*—C. Emmett Pugh

[57] ABSTRACT

An artificial submerged structure and underwater wellhead protection system for sheltering a submerged, permanently or temporarily abandoned wellhead utilizing a sloped structure configured to prevent nets, anchors, and the like from entangling or otherwise damaging the wellhead. The exemplary embodiment of the present invention is in the form of a pyramidal structure which is designed to rest on the sea floor, enveloping the wellhead. The present invention is prefabricated and designed to be assembled on the vessel above the well site before installation on the sea floor. The wellhead protector is designed to protect the wellhead from any anchoring, trawling or related activities, as well as protecting any nets or the like from becoming damaged due to entanglement with the wellhead. Anchoring means is also disclosed for providing a firm placement of the shelter relative the wellhead in those cases where large anchors, oyster dredges, trawl boards and the like might tend to knock over the structure. In addition to the protection structure, the present invention further includes a new and unique temporary abandonment cap for assisting in the automatic centering of the protector, as it is lowered over the wellhead, and for preventing debris from entering the wellbore. The structure is prefabricated at the plant site, transported to the area to be deployed, assembled on site, and lowered to the sea floor after the area has been cleared of debris.

15 Claims, 5 Drawing Sheets

SUBSEA WELLHEAD PROTECTION SYSTEM

BACKGROUND OF INVENTION

1. Field of Invention

The present invention relates to artificial submerged structures, and in particular to a new and unique underwater wellhead protection system for sheltering a submerged, permanently or temporarily abandoned wellhead utilizing a sloped structure configured to prevent nets, anchors, and the like from entangling or otherwise damaging the wellhead.

The exemplary embodiment of the present invention is in the form of a pyramidal structure which is designed to rest on the sea floor, enveloping the wellhead. The present invention is prefabricated and designed to be assembled on the vessel above the well site before installation on the sea floor.

The interior structure of the present invention is designed to be "self centering", and when used in conjunction with the temporary abandonment cap, the unit centers itself as it is lowered over the wellhead, thereby facilitating faster and more cost efficient installation.

The wellhead protector is designed to protect the wellhead from any anchoring, trawling or related activities, as well as protecting any nets or the like from becoming damaged due to entanglement with the wellhead.

Anchoring means is also disclosed for providing a firm placement of the shelter relative the wellhead in those cases where large anchors, oyster dredges, trawl boards and the like might tend to knock over the structure.

In addition to the protection structure, the present invention further includes a new and unique temporary abandonment cap for preventing debris from entering the wellbore. The cap is designed to be used in conjunction with the wellhead protection structure, thereby providing optimal protection for the temporarily abandoned wellhead, and assuring future reinstitution of production, should production ever be desired.

The present invention also includes a new and unique method of fabricating and installing an underwater wellhead protector in which the structure is prefabricated at the plant site, transported to the area to be deployed, assembled on site, and lowered to the sea floor after the area has been cleared of debris.

2. Prior Art & General Background

Offshore oilfield drilling is a heavily regulated industry, replete with procedural guidelines regarding safety, environmental regulations, and other concerns. One of the many areas regulated relates to the procedure for the abandonment of subsea wells.

The U.S. government has recently passed legislation and regulations dictating the proper procedure for abandoning a wellhead to insure that the well has in fact exhausted its ability to extract the resource, that the abandoned well will not pose a hazard to the environment, and that the abandoned well structure will not interfere with operations of commerce such as commercial fishing, navigation, and the like.

In accordance with these goals, the government, in its Code of Federal Regulations and U.S. Coast Guard Regulations, has dictated that abandoned subsea wells must be plugged and cleared from the sea floor such that all wellheads, casings, pilings, and other obstructions are removed to a depth of at least fifteen (15) feet below the mud line. 30 CFR Section 250.112

One can easily appreciate the great difficulties and expenses associated with the removal of subsea wellheads, conductor pipe, and casing below the surface of the seabed, especially at significant sea depths.

Fortunately, the above regulation continues on to read that the requirement for removing subsea wellheads or other obstructions may be reduced or eliminated when the wellheads or other obstructions do not constitute a hazard to other users of the seabed; id.

Thus, in accordance with the above regulations, if one were to modify the wellhead area so that it would not constitute a hazard to other users of the seabed, then presumably the necessity of removing the wellhead and casing to fifteen (15) feet below the mud line could be dispensed with. This presumption has been verified with the authorities.

Therefore, a structure enveloping the wellhead and configured so as not to pose an "obstruction" to other users of the seabed could in many cases be implemented in lieu of the expensive process of removal of the wellhead and casing below the mudline.

With regard to the temporary abandonment of wellheads, 30 CFR 250.113 states in pertinent part that "subsea wellheads, casing stubs, or other obstructions above the seabed remaining after temporary abandonment will be protected in such a manner as to allow commercial fisheries gear to pass over the structure without damage to the structure or the fishing gear".

Again, the implementation of a structure enveloping the wellhead and configured so as not to pose an "obstruction" to other users of the seabed could be implemented in lieu of the removal of the wellhead and casing.

A review of the prior art indicates that there has been little if any innovation with regard to structures designed to house and protect an abandoned subsea wellhead, let alone a structure providing means to allow commercial fishing gear such as trawls, anchors, and the like to pass over the wellhead without damage to the gear or the wellhead. The present invention provides such a structure, configuring the area around the wellhead so as not to be an obstruction to users of the seabed.

A list of prior patents which may be of interest is provided below:

| Patent No. | Patentee(s) | Issue Date |
|---|---|---|
| 4,452,312 | Roblin | June 5, 1984 |
| 4,323,118 | Bergmann | Apr. 6, 1982 |
| 3,543,846 | Smith | Dec. 1, 1970 |
| 3,516,489 | Jergins | June 23, 1970 |
| 3,063,500 | Logan | Nov. 13, 1962 |
| 1,721,805 | Cormier | July 23, 1929 |

As may be ascertained by a review of the above patents, the prior art does not teach a structural device or method for sheltering permanently or temporarily abandoned subsea wellheads, while being configured so as not to interfere with users of the sea bed such as commercial fisherman and the like.

Further, the prior art does not teach a modular subsea shelter unit which is prefabricated and thereby assembled in the field just prior to installation.

The prior art also does not disclose a subsea wellhead shelter having self-centering means of installation, nor does it teach a new and unique gravity held temporary abandonment cap to be used in conjunction with the subsea wellhead shelter.

U.S. Pat. No. 3,063,500 issued 1962 and entitled "Underwater Christmas Tree Protector" teaches "an underwater housing or protector for protecting an underwater christmas tree".

This patent teaches a cylindrical shelter for underwater christmas trees for protecting the christmas tree from the corrosive effects of salt water. The shelter is in the form of a large diameter pipe driven into the sea floor, enveloping the christmas tree. In order to protect the christmas tree from corrosion, a protective oil fills the structure, thus providing a corrosion free environment for the christmas tree.

As may be ascertained by a review of the patent, the structure is obviously distinguishable from the invention made subject this application. The patent relates to a watertight, oil filled structure designed to envelope a christmas tree for corrosion prevention.

The structure as disclosed above is not suitable for the contemplated use as taught in the present invention; further, the structure is not configured in such a manner as to protect the wellhead and commercial users of the sea bottom in accordance with the Federal Regulations. Nor does the above invention teach an easily installed shelter, but rather a complicated, extensive scheme to prevent saltwater corrosion of underwater christmas trees.

Indeed, the configuration of the above structure invites the entanglement of trawls, nets, or the like which might pass over it. The main body of the structure is in the same cylindrical, vertical form as the naked wellhead, and thus provides little utility or opportunity for use under the federal guidelines discussed above. The elongated rods implemented in a horizontal sloping form above the shelter as disclosed in FIG. 4 would not prove effective in preventing nets, anchors, etc., from becoming entangled in the structure and would in fact invite entanglement.

U.S. Pat. No. 3,543,846 issued 1970 and entitled "Underwater Oil or Gas Facility" teaches a reinforced concrete underwater structure of a frustoconical configuration and having the capability of serving as an underwater production, oil-gas separation facility, or storage facility.

The principal embodiment of the above patent teaches a rather large underwater structure, essentially serving as an underwater production platform. The exemplary embodiment appears to be the height of a 15 story building, and figures in the patent show personnel operating equipment therein.

Again, the present invention is obviously distinguishable from the above patent. The similarity of the general configuration of the two structures is the only pertinent trait. The patent does not teach an easily implemented, cost effective wellhead shelter and method of isolating the wellhead such that is does not pose a hinderance to navigation or commerce as disclosed in the present invention and is thus readily distinguishable.

Thus, based upon the above and foregoing, one can readily ascertain that the searched for invention has not been anticipated in the prior art.

GENERAL, SUMMARY DISCUSSION OF THE INVENTION

The present invention primarily comprises a new and unique apparatus and method for fabricating and installing a temporary or permanent wellhead abandonment shelter for an underwater well in the form of a reinforced structure having a uniformly ascending slope.

The method as taught in the present patent discloses fabrication of the structure on site utilizing readily assembled modular components. After the structure has been assembled, it is then lowered underwater to the ocean floor, enveloping the wellhead and providing an outer configuration which allows nets, trawls, anchors and the like to deflect off of the side of the structure rather than become entangled in the wellhead.

The exemplary embodiment of the present invention teaches a wellhead shelter having a modular construction comprised of sectionalized eight foot triangular corner members sloping in a uniformly upward fashion and having a square base and top, the base having greater diameter than the top, thus forming the pyramid configuration.

The corner members are comprised of two right triangle configuration planer members weldingly affixed to one another utilizing four inch schedule "40 A120" structural pipe.

Side wall members may be joined to the corner members utilizing perpendicular planer connection members incorporating tap holes juxtaposed in a descending fashion for providing a means of affixing the members utilizing a nut and bolt arrangement. The side wall members are optional and may be utilized to expand the linear space encompassed by the shelter for covering multiple wellheads on the sea floor. A structure may be composed solely of four triangular corner members; this would provide sufficient coverage for a single wellhead.

The sloping side wall and corner members are reinforced via angle iron horizontally spaced at approximate one foot intervals; the angle iron is weldingly affixed to the members and is comprised of schedule "836" steel.

Also disclosed is the implementation of a new and unique temporary abandonment cap which is used in conjunction with the protection shelter. The cap is configured to protect the wellbore from any objects which might become lodged in the borehole. The cap further includes an upper section configured to provide easier installation and centering of the wellhead shelter. The cap is gravity held and is thereby easily installed and removed.

The present structure also teaches the utilization of "centralizers" to act as centering devices to center the structure on the wellhead during installation. The "centralizers" comprise a plurality of triangular members weldingly affixed to the inside of the structure and configured to engage the upper wellhead and/or temporary abandonment cap to cause the structure to center itself with regard to the wellhead while the structure is being lowered into place.

In situations which demand very solid placement of the shelter over the wellhead, the present invention further teaches the utilization of eight "Helicoil" anchors implemented in such a manner as to provide two anchors affixed to each corner of the structure.

It is thus an object of the present invention to provide a temporary abandonment shelter for underwater wells which is structured so as to be prefabricated and thereby modularly assembled on site prior to installation.

It is a further object of the present invention to provide a temporary abandonment shelter for underwater wells which is internally configured to be self centering during installation over the well, thereby facilitating easier placement.

It is a still further object of the present invention to provide a temporary abandonment shelter for underwater wells configured to allow nets, trawls and the like to pass over the wellhead, avoiding damage to both the wellhead and net, etc.

It is another object of the present invention to provide a new and unique method of protecting a submerged wellhead in which the wellhead is sheltered in such a manner as to provide a protective surface over the wellhead which would not pose an obstacle to commerce on the sea floor.

It is still another object of the present invention to provide a temporary abandonment cap which is placed over the exposed well and used in conjunction with the temporary abandonment shelter.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 1:
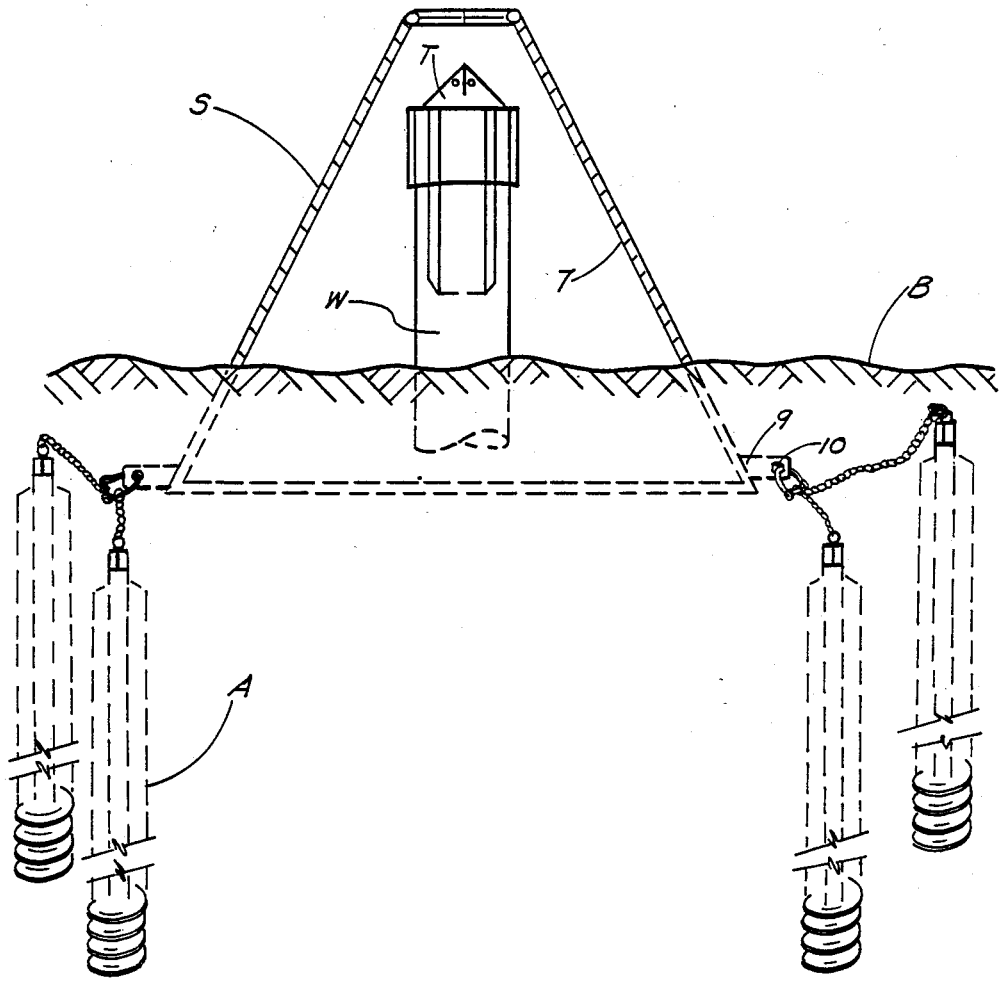
FIG. 1 is a side, partially cross-sectional view of the preferred embodiment of the present invention illustrating the entire protection system in its installed state relative the wellhead and the immediate environment.
Figure 2:
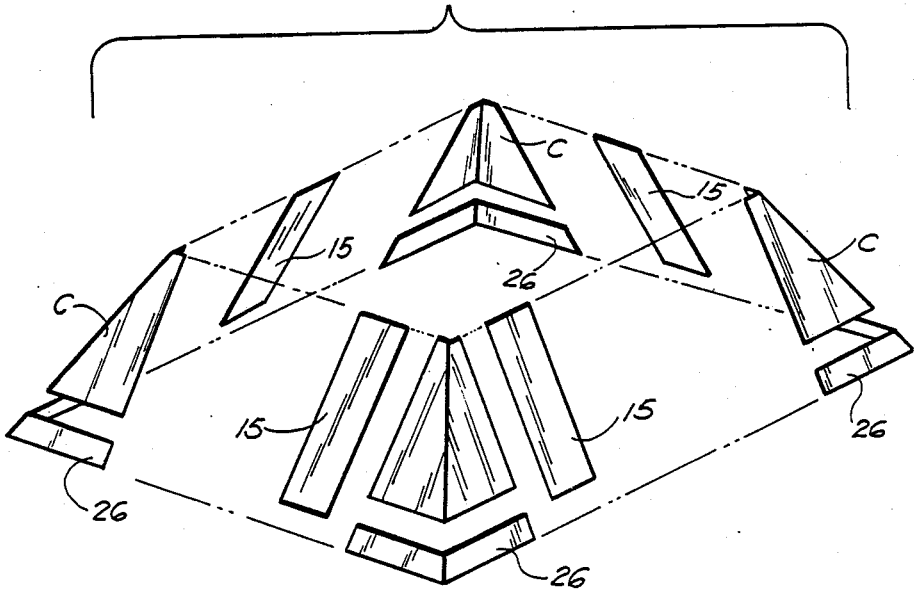
FIG. 2 is a perspective, exploded view of the wellhead protector of the present invention illustrating the relative placement of the multi-well panels, as well as the overall configuration of the various other structural configurations comprising the preferred embodiment of the present invention.
Figure 3:
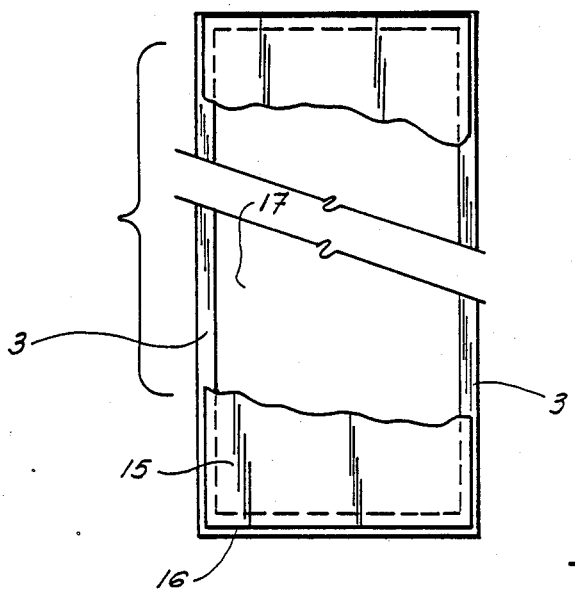
FIG. 3 is a side, cut-out view of a multi-well panel member of the wellhead protector of the present invention illustrating the reenforcement tubing members and their placement.

As may be ascertained from a viewing of FIG. 1, the preferred embodiment of the present invention comprises a sloped shelter S, anchoring means A attached thereto, and wellhead capping means T. The system is designed to envelope the wellhead W, and is configured in such a manner as to prevent damage to the wellhead and any nets, trawls, or the like which might come into contact therewith.

As may be ascertained by a viewing of FIGS. 1–9, shelter means S is comprised of several prefabricated sections assembled on site prior to installation. The exemplary embodiment of the present invention teaches the utilization of triangular structural quarter members 1 comprised primarily of one quarter inch ($\frac{1}{4}''$) mild steel ("836" material). The quarter member of the exemplary embodiment is approximately eight (8) feet wide and thirteen (13) feet from base to top. The upper portion 20 of the quarter member includes horizontal enforcement means in the form of structural tubing weldingly affixed to the plate steel and is four inches wide.

Figure 8:
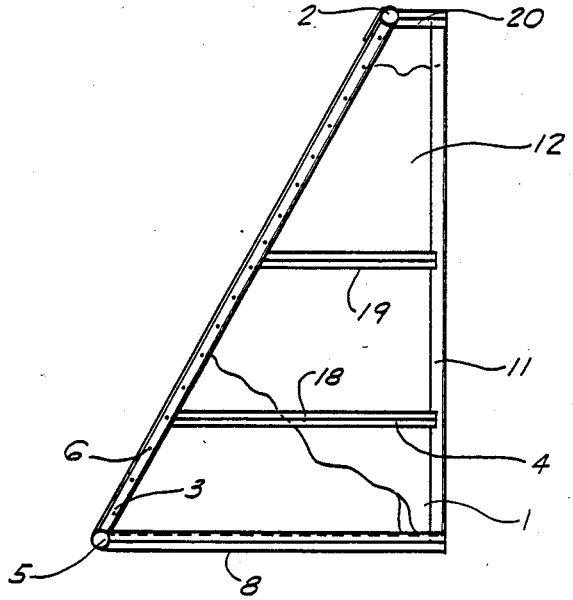
FIG. 8 is a side, cut away view of the corner panel member of the preferred embodiment of the present invention illustrating placement of the tubular supports and the perpendicular edge planer connection member.

FIG. 8 details the components of the quarter member 1. The quarter member 1 is configured as a right triangle and includes reinforcement means weldingly affixed in the form of four inch (4") schedule "40" structural tubing horizontally positioned along the base 8 of quarter member 1.

Also horizontally affixed to quarter member 1 is angle iron 4, composed of "836" steel; the exemplary embodiment utilizes two by two by a quarter ($2''\times2''\times\frac{1}{4}''$) inches sections. The lower angle iron support 18 in the exemplary embodiment is spaced approximately three feet from the base 8. The upper angle iron support 4 is spaced approximately four feet from the base. It is noted that the taller the quarter member 1, the more horizontal angle iron support members would be implemented at approximate three to four (3–4') foot intervals.

The uppermost structural tubing horizontal support 20 is spaced along the upper edge of quarter member 1 approximately thirteen (13) feet from the base.

Weldingly affixed at a ninety degree angle vertical to the base is structural tubing member 11; this member is also comprised of four inch schedule "40 A120" structural pipe. As may be appreciated by a viewing of FIG. 8, tubing member 11 is affixed to the inner area of the quarter member near the vertical edge of quarter member 1.

Weldingly affixed adjacent to the inner sloping side of quarter member 1 is angle iron/planer connection member 3. Connection member 3 provides vertical structural support as well as providing planer means for connecting one structural member to another. Connection member 3 includes a plurality of vertical descending tap holes 6 which allows one structural member to be joined to another in the field utilizing standard nut, bolt and washers.

Figure 9:
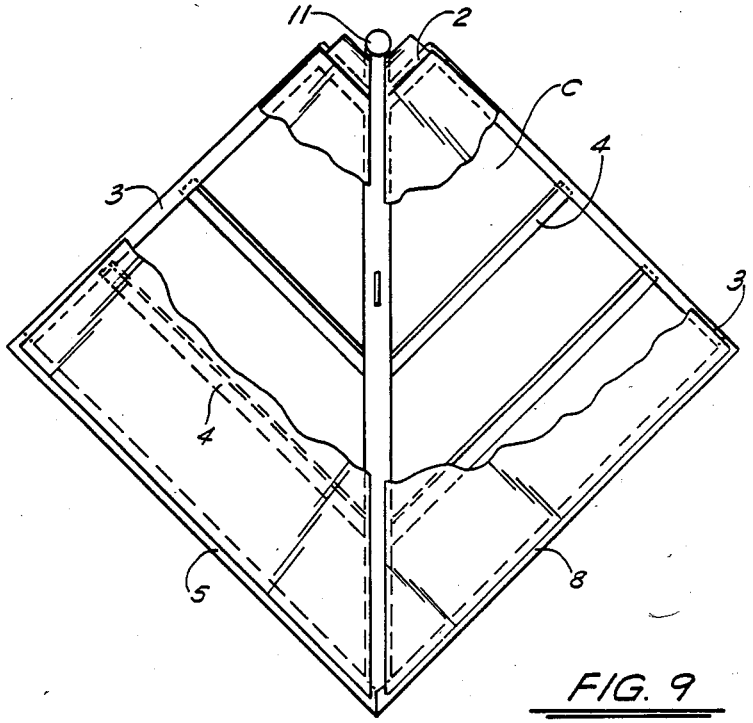
FIG. 9 is a top, perspective, partially cut-away view of the quarter section of the present invention, illustrating the placement of the pipe stiffeners and structural support members.

As may be appreciated by a viewing of FIG. 9, in fabricating the structure S of the present invention, the quarter panel 1 may be joined to another quarter panel 1, thereby forming a corner member by weldingly affixing the two quarter panel members sharing a common vertical structural tubing member 11.

In the exemplary, embodiment, the two quarter members are affixed at right angles to one another, thereby forming a one-quarter pyramid. Four of these quarter members may be joined on site utilizing a common nut, bolt, and washer arrangement at planer connection members 3 to form a sloping protective structure S, or pyramid.

For sheltering a single wellhead, a pyramid configuration may be sufficient. However, for sheltering multiple linearly spaced wellheads as short intervals, it might not be possible to utilize a single pyramid configuration shelter, and the wellheads could be spaced so as to prevent the multiple pyramid shelters from being used side by side. In such an instance, one may utilize the multi-well side panel 15, illustrated in FIG. 3.

Panel 15 is similar in structure to quarter panel 1, with the exception of the configuration. Panel 15 is rectilinear in configuration, and is designed to fit juxtaposed to the corner members to add a linear dimension to the "pyramid" configuration of the structure S. Panel 15 has on each vertical edge planer connection members 3 with tapholes 6 spaced to join with those of the corner members, thereby acting as a linear extension to the structure for covering multiple wellheads.

For horizontal reinforcement, panel 15 includes at its base structural tubing member 16 identical in size and constitution as its counterpart in the quarter member 8. The horizontal angle iron member 7 is likewise identical to its counterpart(s) 4, 19 as taught in the quarter panel member. It is also noted that, in the exemplary embodiment of the present invention, panel 15 is composed of one-quarter inch steel 17 just as the quarter members 12.

Figure 4:
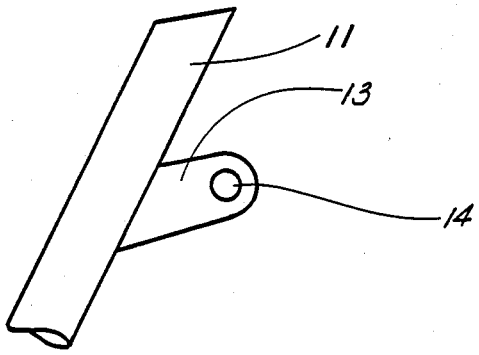
FIG. 4 is a side view of the lift lug of the preferred embodiment of the present invention.

As may be appreciated from a viewing of FIG. 4, for transporting the shelter S from the vessel to the seabed, the invention includes the implementation of a lift lug 13 having tap hole 14 weldingly attached to the upper portion of vertical structural tubing member 11.

Thus completes the exemplary embodiment(s) of the structure S of the present invention.

Also disclosed as part of the invention is a temporary abandonment cap T to be used in conjunction with the wellhead protection system.

Figure 5:
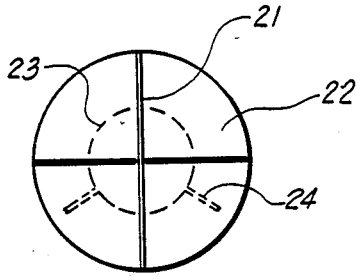
FIG. 5 is a top view of the temporary abandonment cap of the preferred embodiment of the present invention illustrating the retaining shaft and fins in phantom.
Figure 6:
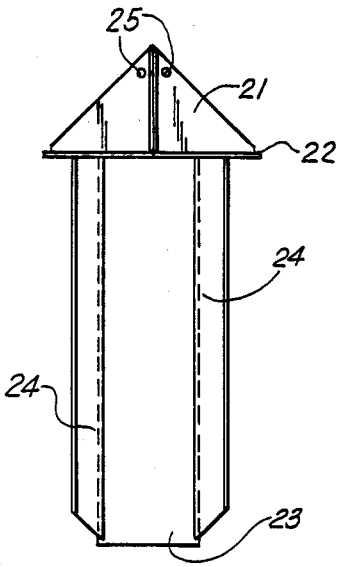
FIG. 6 is a side view of the temporary abandonment cap of the preferred embodiment of the present invention.
Figure 7:
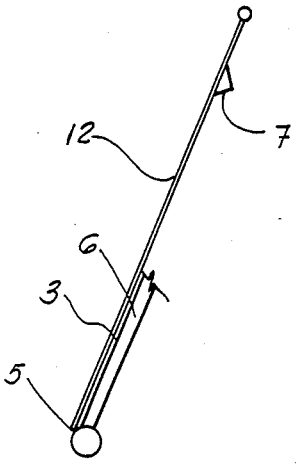
FIG. 7 is a side, cut-away view of the side multi-well panel of the preferred embodiment of the present invention.

As may be ascertained by a viewing of FIGS. 5 and 6, the cap T of the present system includes a base 22 of larger diameter than the casing to which it is to protect for preventing the cap t from being lodged therein. Vertically descending from the lower side of the base 22 is cylindrical member 23, which is of a lesser diameter than the casing of the wellhead W. Weldingly affixed at a ninety degree angle from the sides of member 23 are centering members 24. These members 24 are configured to center the cap on the casing of the wellhead W.

Weldingly affixed to the upper part of base 22 are centralizer fins 21. Centralizer fins 21 are comprised of a plurality of right triangular members affixed such that the hypotenuse of each member faces to the outer portion of the cap, forming a descending slope. The upper portion of fins 21 includes tap holes 25 for lowering the cap T into place over the wellhead W.

In installing the system, the corner and side panels members are prefabricated according to the size of the wellhead to be sheltered and transported to the site, at which time the shelter will be assembled in to its final form.

Figure 10:
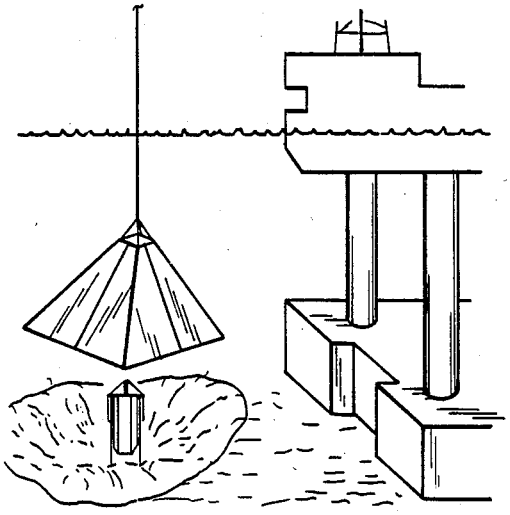
FIG. 10 illustrates the lowering of the wellhead shelter of the preferred embodiment of the present invention over the prepared wellhead site on the seabed.
Figure 11:
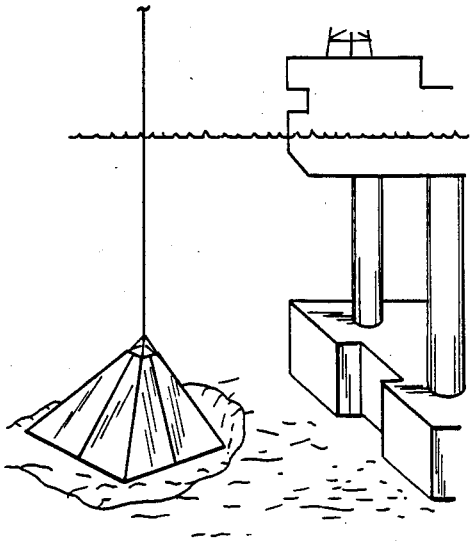
FIG. 11 illustrates the wellhead shelter lowered over the wellhead and centered utilizing the self centering/-stiffener member of the structure in conjunction with the temporary abandonment cap.
Figure 12:
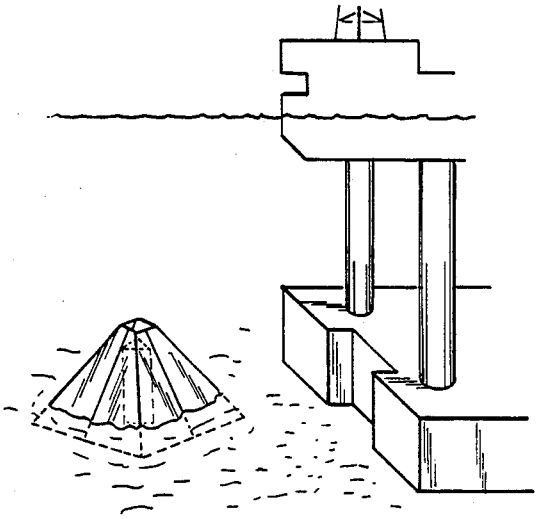
FIG. 12 illustrates the wellhead protection system installed upon the seabed without the helicoil anchoring system.

As may be appreciated by reference to FIGS. 10–12, before the shelter S is lowered, the temporary abandonment cap T, sized to the wellhead W, is lowered and installed such that the centralizer fins 21 fit over the casing or conductor pipe of the wellhead W.

The site around the wellhead W is then prepared for installation of the shelter. Divers remove approximately three to four feet of the seabed in the vicinity of the wellhead to a sufficient dimension to encompass the shelter. This greatly strengthens the placement of the structure S, anchoring it to the sea bottom once it has been installed.

Utilizing the lift lug 13, the shelter S is lowered over the wellhead. The centralizer fins 21 on the abandonment cap T, along with the angle irons 4, 19 of the structure center the structure over the wellhead automatically, thereby significantly reducing the amount of divers necessary for installation. The shelter is lowered into the excavated area, resting below the surface of the seabed. The excavated seabed is then placed around the outer walls of the shelter for anchoring as discussed supra.

As may be ascertained by a viewing of FIG. 1, if additional anchoring is desired, divers may wish to install "helicoil" type anchors or the like to the structure before covering the walls. If such is the case, chain padeye 9 is mounted to the corner edges of the structure S; the padeye 9 includes taphole 10 for securing a chain, cable, or the like from the structure to a helicoil anchor A.

Typically, the padeye 9 would be installed on two corners of the pyramid, and each padeye would be anchored by two "Helicoil" anchors A as illustrated.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. An apparatus for protecting an underwater abandoned wellhead having an open top, said apparatus comprising:

a wellhead shelter, said shelter comprising a hollow structure of a size and configuration to substantially envelope the underwater abandoned wellhead, said shelter further comprising a base and vertically ascending exterior walls having sloping undersides capable of sheltering the wellhead from undersea commerce and preventing undersea commerce from becoming entangled in said shelter or wellhead, and a supplemental centering cap associated with said shelter and placeable on top of the wellhead before said shelter is lowered over the wellhead, said cap having a lower portion and an upper portion, said upper portion having a base and upper sloping side edges, said lower portion having a lesser width than said base of said upper portion allowing it to be placed into the open top of the wellhead, said base of said upper portion having a greater width than the width of the top of the wellhead allowing said cap to rest on and be stably supported by the top of the wellhead with said lower portion extending into the wellhead, said upper sloping side edges being capable of engaging the sloping undersides of said walls of said shelter to cause said shelter to be centered about the top of the wellhead as said shelter is lowered down about the wellhead.

2. The apparatus of claim 1, wherein said apparatus includes anchoring means comprising a multiple number of screw-type subterranean anchors affixed to the base of said structure.

3. The apparatus of claim 1, wherein the exterior of said structure has a pyramid configuration.

4. The apparatus of claim 1, wherein said structure is prefabricated in separate wall sections, transported to the wellhead installation site unassembled with at least some of said wall sections being separated and unattached, with said wall sections assembled at the wellhead installation site.

5. The apparatus of claim 1, wherein said exterior walls are comprised of sheet steel reinforced with structural tubing members.

6. The apparatus of claim 1, wherein said exterior walls are comprised of sheet steel reinforced with elongated angle iron members.

7. An apparatus for protecting an underwater abandoned wellhead, comprising:

a wellhead shelter having a hollow structure of a size and configuration to substantially envelope the underwater abandoned wellhead, said structure including a base and vertically ascending exterior walls capable of sheltering the wellhead from undersea commerce and reducing the likelihood of undersea commerce from becoming entangled in the shelter or wellhead, said structure being prefabricated in separate wall sections, transported to the wellhead installation site unassembled with at least some of said wall sections being separated and unattached, with said wall sections assembled at the wellhead installation site; said structure including separable panels forming said walls and having side edges, said panels being mechanically joined together at their side edges by mechanical fasteners forming said shelter, said wellhead having an open top and said panels having sloping undersides;

a supplemental capping device associated with said shelter and stably placeable on top of the wellhead and stably supported by the wellhead, said capping device further including deflecting means having sloped side edges for deflecting said shelter from the wellhead as said shelter is being lowered over the wellhead, said capping device facilitating the centering of said structure around the wellhead via the load bearing interfacing of said sloped side edges of said capping device and the sloped undersides of said panels of said structure.

8. The apparatus of claim 7, wherein said capping device has a lower portion and an upper portion, said upper portion having a base and upper sloping side edges, said lower portion having a lesser width than said base of said upper portion allowing it to be placed into the open top of the wellhead, said base of said upper portion having a greater width than the width of the top of the wellhead allowing said capping device to rest on and be stably supported by the top of the wellhead with said lower portion extending into the wellhead.

9. A method of protecting an abandoned wellhead and immediate area on a sea bottom, so that the wellhead and area do not pose a hindrance to undersea commerce, such as trawling, fishing, and the like, said method comprising the following steps:

a. prefabricating a protective structure having exterior walls designed to envelope and protect that portion of the abandoned wellhead protruding up from the surface of the sea bottom, with the walls being made of a series of separate, rigid, extended surface wall sections, which are separately made and handled during prefabrication and are ultimately used at the wellhead site to form the walls of the protective structure;

b. transporting said structure from the fabrication site to the installation, wellhead site with at least some of said separate wall sections being in unassembled, separated form;

c. assembling together the unassembled wall sections, forming the prefabricated structure at the abandoned wellhead, installation site prior to installation;

d. preparing the wellhead site, including excavating a portion of the sea bottom immediately surrounding the wellhead, so that the excavation is sufficiently large and deep enough to encompass the bottom of the protective structure, while allowing said structure to envelope said wellhead;

e. adding a rigid centering cap having downwardly sloping side edges on top of the wellhead with the centering cap being supported by and on top of the wellhead;

f. lowering the assembled structure over said wellhead and onto the base of the excavation, simultaneously centering said structure relative to said wellhead;

g. centering the structure with respect to the top of said wellhead using the engagement of the undersides of said structure bearing down against said downwardly sloping side edges as the structure is lowered; and h. covering the bottom of said lowered assembled structure with said excavated material, anchoring and strengthening the protective structure around the wellhead, reducing the likelihood of undersea commerce being entangled with the wellhead and immediate area.

10. The method of claim 9, wherein there is included the further step of:

attaching anchoring means of the subterranean screw-type to the base of said structure.

11. The method of claim 9, wherein the wellhead has an open top area, and wherein there is included the further step(s) of:

providing said centering cap with a downwardly extending, centrally located member at the underside of the cap; and in step "d" inserting said centrally located member within the interior of said open top wellhead to position it with respect to the wellhead and using the underside of said cap to rest the cap on and have it supported and maintained in place by the top edges of the open wellhead under the action of gravity.

12. The method of claim 11, wherein there is included the further step(s) of:

providing said centrally located member with downwardly, inwardly sloped side edges; and using the bearing engagement of said inwardly sloped side edges against the top edges of said open wellhead to center said cap on said wellhead.

13. A method of protecting an abandoned wellhead and immediate area on a sea bottom, comprising the following steps:

a. providing a protective structure, having a wall structure with an underside with ascending surfaces, for surrounding and enveloping the wellhead at the wellhead site;

b. installing a rigid centering cap having downwardly sloping side edges on top of the wellhead with the centering cap being supported by and on top of the wellhead; and c. lowering the structure down over said wellhead and onto the subsea surface and simultaneously centering said structure relative to the wellhead by using the engagement of the ascending surfaces of the underside of said structure bearing down against said downwardly sloping side edges of said rigid centering cap as the structure is lowered to center the structure with respect to the top of said wellhead.

14. The method of claim 13, wherein the wellhead has an open top and there is included the further step(s) of:

providing said centering cap with a downwardly extending, centrally located member at the underside of the cap; and inserting said centrally located member within the interior of said open top wellhead to position it with respect to the wellhead and using the underside of said cap to rest the cap on and have it supported and maintained in place by the top edges of the open wellhead under the action of gravity.

15. The method of claim 14, wherein there is included the further steps of:

providing said centrally located member with downwardly, inwardly sloped side edges; and using the bearing engagement of said inwardly sloped side edges against the top edges of the open wellhead to center said cap on the wellhead.

* * * * *